US010794140B2

(12) United States Patent
Nguyen

(10) Patent No.: US 10,794,140 B2
(45) Date of Patent: Oct. 6, 2020

(54) SYSTEMS AND METHODS TO REDUCE BREAK-OUT TORQUE

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 877 days.

(21) Appl. No.: 15/145,763

(22) Filed: May 3, 2016

(65) Prior Publication Data

US 2016/0326825 A1 Nov. 10, 2016

Related U.S. Application Data

(60) Provisional application No. 62/156,663, filed on May 4, 2015.

(51) Int. Cl.

| | |
|---|---|
| ***E21B 33/04*** | (2006.01) |
| ***E21B 23/00*** | (2006.01) |
| ***E21B 17/02*** | (2006.01) |
| ***E21B 23/02*** | (2006.01) |
| ***E21B 33/03*** | (2006.01) |
| ***E21B 23/01*** | (2006.01) |

(52) U.S. Cl.

CPC ..... *E21B 33/04* (2013.01); *E21B 17/02* (2013.01); *E21B 23/00* (2013.01); *E21B 23/01* (2013.01); *E21B 23/02* (2013.01); *E21B 33/03* (2013.01)

(58) Field of Classification Search

CPC ..... E21B 33/04; E21B 17/02; E21B 23/00; E21B 23/01; E21B 23/02; E21B 33/03

See application file for complete search history.

(56) References Cited

U.S. PATENT DOCUMENTS

| | | | |
|---|---|---|---|
| 2,103,601 | A | 12/1937 | Stigall |
| 3,625,283 | A | 12/1971 | Ahlstone |
| 4,051,896 | A | 10/1977 | Amancharla et al. |
| 4,171,018 | A | 10/1979 | Walker |
| 4,416,472 | A | 11/1983 | Fowler et al. |
| 4,601,343 | A | 7/1986 | Lindsey, Jr. et al. |
| 4,658,915 | A | 4/1987 | Gods et al. |
| 8,528,650 | B1 | 9/2013 | Smith et al. |
| 8,662,189 | B2 | 3/2014 | Harsono et al. |
| 2008/0230229 | A1 | 9/2008 | Shaw et al. |
| 2012/0305269 | A1 | 12/2012 | Bories et al. |
| 2014/0311753 | A1 | 10/2014 | Hanson et al. |
| 2015/0152701 | A1 | 6/2015 | Levert, Jr. et al. |
| 2015/0247387 | A1 | 9/2015 | Massey et al. |
| 2015/0260002 | A1 | 9/2015 | Nguyen et al. |

*Primary Examiner* — Yong-Suk (Philip) Ro

(74) *Attorney, Agent, or Firm* — Eubanks PLLC

(57) ABSTRACT

A system including a wellhead hanger, such as a casing hanger, and a running tool with a stopping protrusion that reduces the likelihood over-torqueing of threads coupling the running tool to the wellhead hanger and that reduces the break-out torque for disengaging the running tool and wellhead hanger from each other upon the completion of casing string cementing. Limiting the thread-per-inch count of the hanger and running tools, respectively, to the range of two threads-per-inch to four threads-per-inch also lowers the break-out torque between the hanger and running tool.

4 Claims, 6 Drawing Sheets

SYSTEMS AND METHODS TO REDUCE BREAK-OUT TORQUE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to a wellhead completion system. The system can include a wellhead hanger. The system can also include a running tool with a threaded portion coupling the running tool to the wellhead hanger. In an embodiment, the running tool comprises a first protrusion extending below the threaded portion.

Certain embodiments of the present disclosure generally relate to a wellhead completion method. The method can include providing a running tool having a stopping protrusion extending below a threaded portion of the running tool. The method can also include providing a wellhead hanger having a receiving protrusion. The method can further include rotating the running tool in a first direction with respect to the wellhead hanger until the stopping protrusion of the running tool engages with the receiving protrusion of the wellhead hanger.

Further embodiments of the present disclosure generally relate to a well completion system. The well completion system can include a mandrel-style wellhead hanger and a running tool. The wellhead hanger can include a neck portion configured to guide a running tool to a position about the wellhead hanger. The wellhead hanger can also include a threaded portion configured to threadedly engage the running tool during an operation. The wellhead hanger also includes a rotation-stopping protrusion configured to abut the running tool and prevent over-torque. The well completion system additionally includes a running tool with a threaded portion configured to couple the running tool to the wellhead hanger. The running tool includes a second protrusion extending below the threaded portion on an inner surface of the running tool that engages the rotation-stopping protrusion of the wellhead hanger.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Embodiments of the present disclosure generally relate to hangers and running tools for suspending tubular strings from wellheads. Generally, wellhead hangers can be attached to the tubular strings and installed in a wellhead assembly with running tools threaded onto the hangers. Once a hanger is installed in the wellhead, the running tool can be unthreaded from the hanger and removed. Problems can arise with overcoming break-out torque, or with over- or under-torqueing the connection of the running tool to the hanger. Specifically, if the make-up torque is too high, the threads may be damaged or overstressed causing its failure and the loss of a portion of the string in the well. By providing a stopping protrusion on the running tool, break-out torque can be lowered and over-torqueing prevented. A second abutting protrusion on the wellhead hanger can also provide lowered break-out torque and prevention of over-torqueing. Limiting the thread-per-inch count of the threaded portion of the running tool to the range of two threads per inch to four threads per inch can also lower the break-out torque between the running tool and the wellhead hanger.

Figure 1:
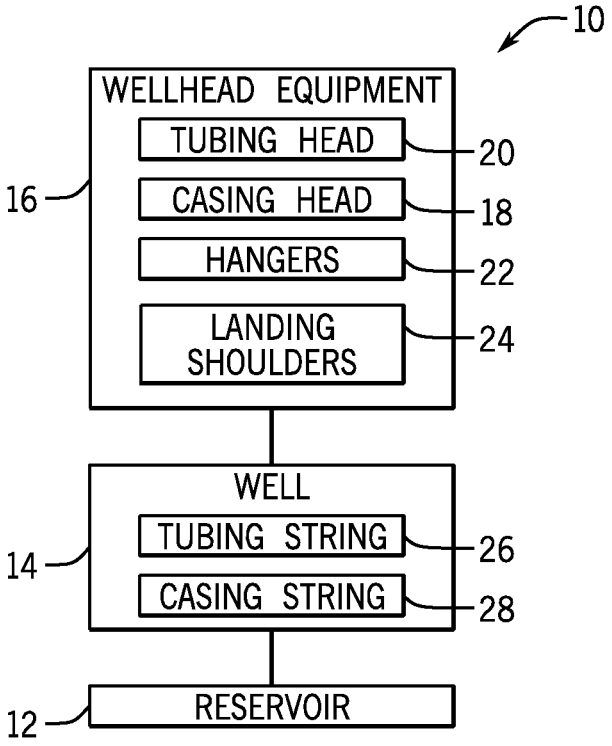
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Rotating a casing string during cementing can increase uniformity of the cement about the casing string and reduce the size or frequency of undesirable cavities or fissures in the cement. Further, rotating tubular strings can also facilitate running of the strings into the well through the wellhead. Any suitable devices or machines may be used to rotate the wellhead hangers (and their attached tubular strings) and to run the strings into wells. For example, a top drive can be used to run a casing string into a well and to rotate the casing string. In some instances, the tubular strings are rotated via wellhead hangers attached to the strings.

Figure 2:
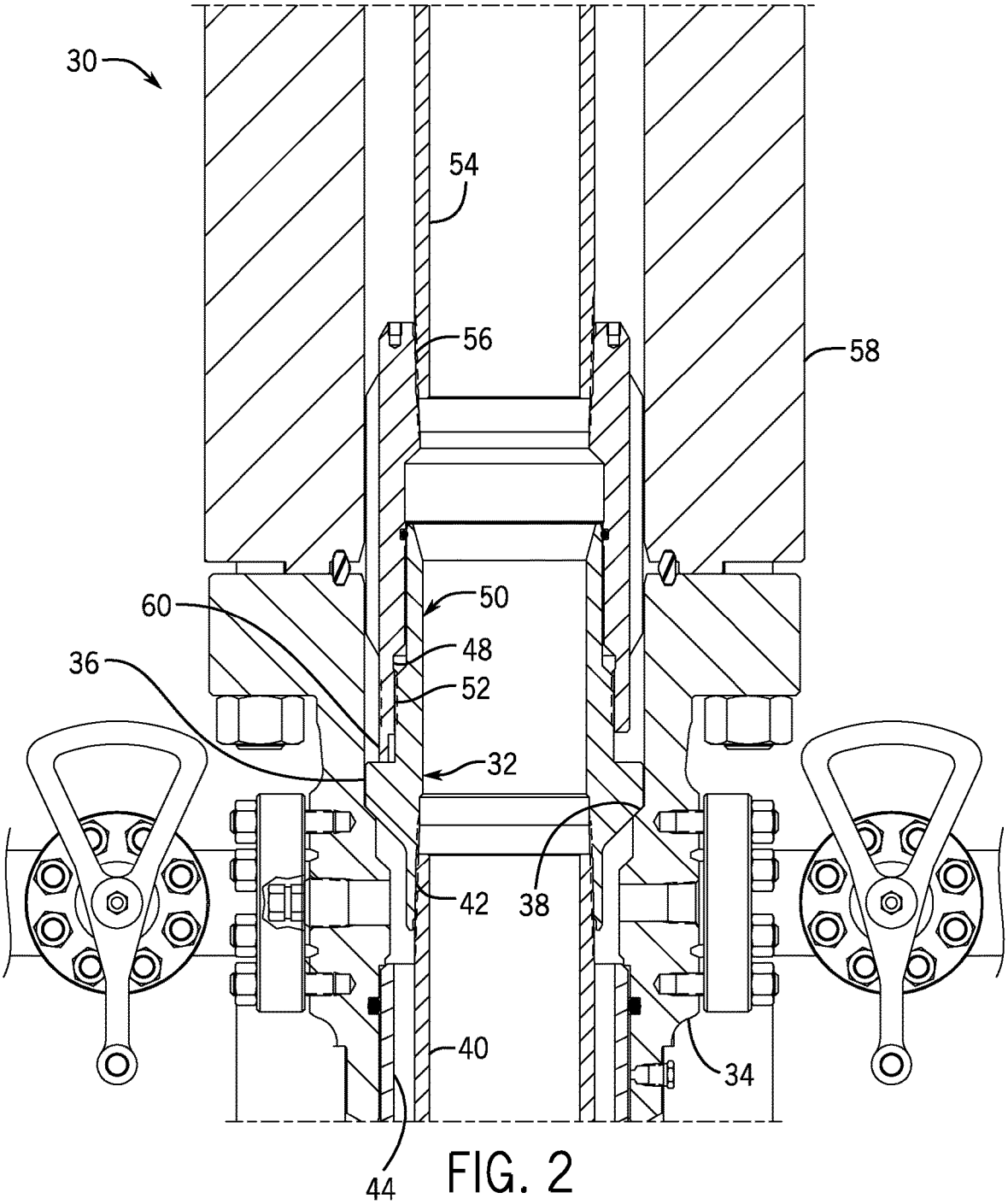
FIG. 2 is a cross-section of a wellhead assembly including a running tool, with a stopping protrusion, threaded onto a casing hanger, in accordance with one embodiment.
Figure 3:
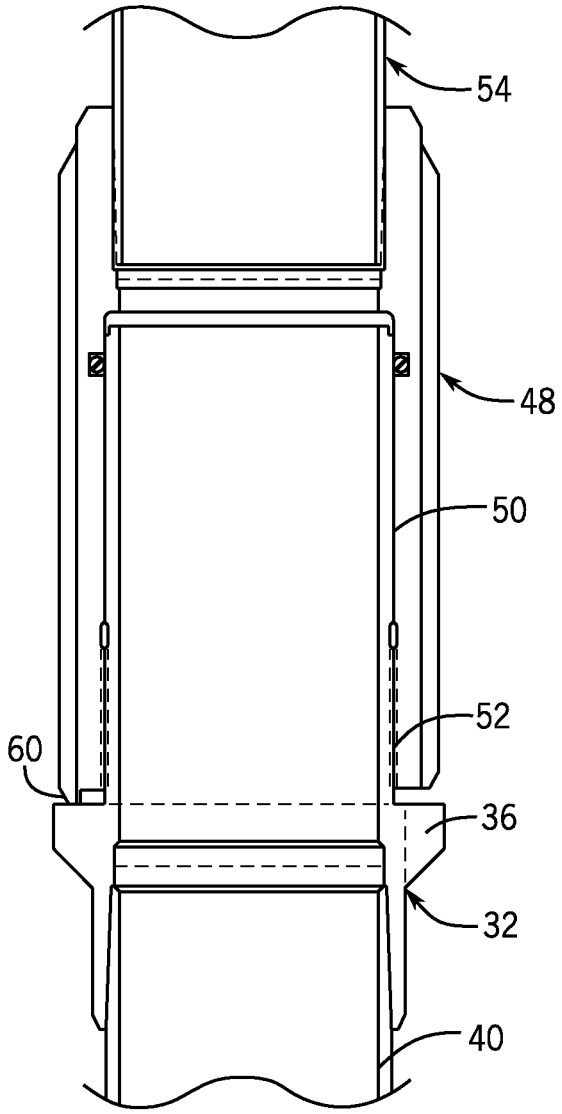
FIG. 3 is a schematic of a running tool, with a stopping protrusion, threaded onto the casing hanger, in accordance with one embodiment.

One example of a wellhead assembly 30 having a hanger installed in a hollow wellhead body is depicted in FIGS. 2 and 3. As shown in this figure, the hanger is provided as a mandrel-type casing hanger 32 installed in a casing head 34. The casing hanger 32 includes a shoulder 36 that is landed onto a mating landing shoulder 38 of the casing head 34. While the shoulders 36 and 38 are depicted as integral shoulders of the casing hanger 32 and casing head 34, the shoulders could be provided separately in other embodiments. Although not shown in the present figure, it will be appreciated that the shoulder 36 can include flow-by recesses that allow fluid to flow through the shoulder 36 when the casing hanger 32 is installed in a wellhead.

A casing string 40 is attached to the casing hanger 32 by way of a threaded interface 42. This allows the casing string 40 to be lowered into a well 14 through the wellhead assembly 30 via the casing hanger 32. The casing string 40 can be run through other casing strings of greater diameter within the well, such as through a wider casing string attached to a casing hanger 44 also within the wellhead.

A running tool 48 is used to run the casing hanger 32 into the casing head 34. In FIGS. 2 and 3, the casing hanger 32 has a neck 50 above the shoulder 36. The running tool 48 is threaded onto a threaded portion 52 of the neck 50. The threaded portion of the neck 50, and the corresponding threads on the running tool 48, may have a thread profile that is between two threads-per-inch and four threads-per-inch, or between 2 to 4 TPI. These thread profiles reduce static friction between the engaged hanger and running tool and, in turn, reduce the break-out torque for disengaging the two components. The break-out torque is the initial force needed to start rotational motion of the running tool about its axis with respect to the wellhead hanger, determined at least in part by the amount of static friction between the running tool and wellhead hanger.

A landing joint 54 is also attached to the running tool 48 via a threaded interface 56. The landing joint 54 and the running tool 48 may be operated to lower the casing hanger 32 into the wellhead and the casing string 40 into the well. In some embodiments, the casing string 40 and the casing hanger 32 may be lowered through an additional wellhead component 58, such as through a blowout preventer stack, connected to the casing head 34. The landing joint 54 can be used to rotate the running tool 48, the casing hanger 32, and the casing string 40, such as during cementing of the casing string 40 within the well.

The illustrated running tool 48 has a stopping protrusion 60 that interacts with the hanger 32. Specifically, as the running tool 48 is threaded onto the wellhead hanger 32, the stopping protrusion 60 abuts the shoulder 36 and resists further rotation of the running tool 48 with respect to the hanger 32, reducing the likelihood of over-torqueing of the threads 52. By combining a reduced risk of over-torqued connections with a lower thread count per inch, which lowers the break-out torque for disengaging the running tool 48 and hanger 32, failures involving loss of casing during cementing operations can be reduced.

Figure 4:
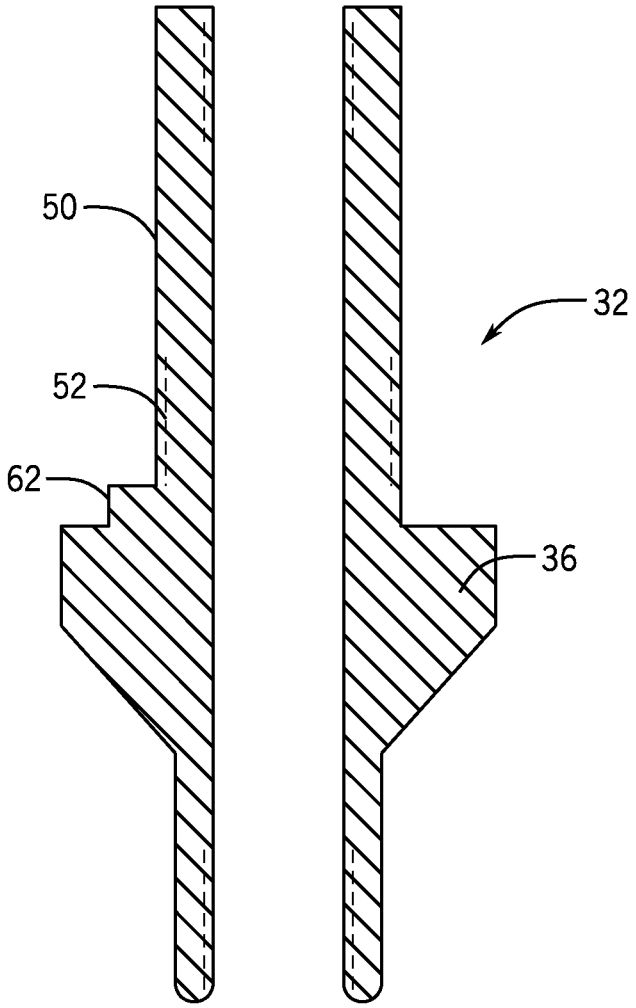
FIG. 4 is a schematic of a wellhead hanger having a receiving protrusion, in accordance with one embodiment.

FIG. 4 illustrates an alternate embodiment of the present invention in which the wellhead hanger 32 has a receiving protrusion 62. In the illustrated embodiment, the receiving protrusion 62 is located on the shoulder 36 just below the threads 52. The receiving protrusion 62 is designed to engage with the stopping protrusion 60 of the running tool 48. For example, as the running tool 48 is threaded onto the wellhead hanger 32, the stopping protrusion interacts with the receiving protrusion to prevent further rotation of the running tool 48 with respect to the hanger 32. Moreover, the interaction of the two protrusions allows torque applied to the landing string—during casing cementing operations, for instance—to effect rotation of the wellhead hanger 32 and casing string 40 without permitting over-torqueing of the threads 52.

Figure 5:
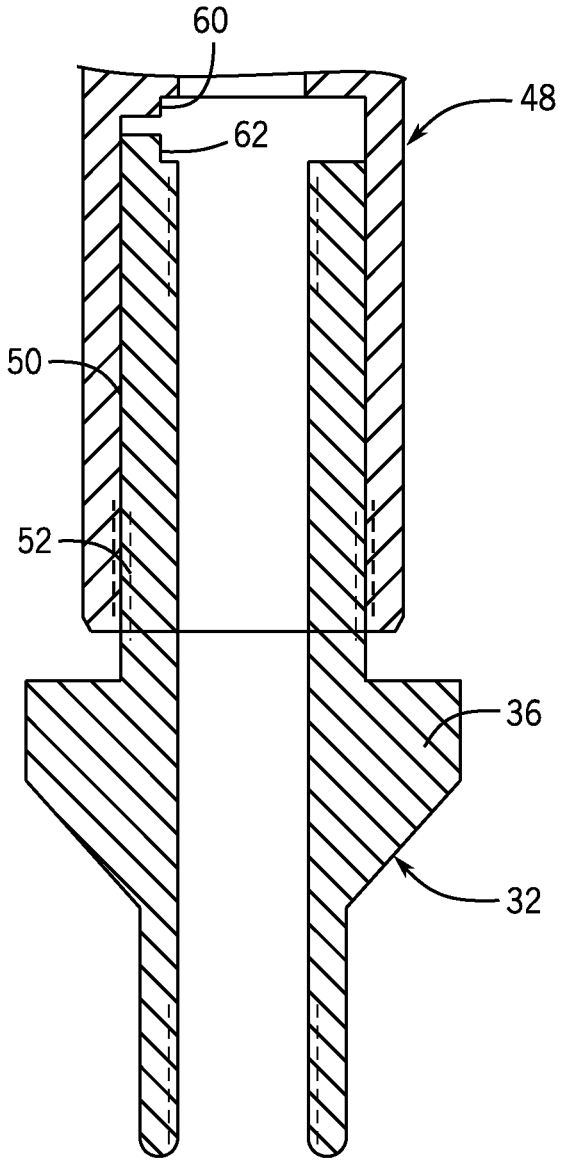
FIG. 5 is a schematic of a wellhead hanger having a receiving protrusion, and a running tool with a mating protrusion, in accordance with an alternative embodiment.

Turning now to FIG. 5, an alternate embodiment of the present invention is shown in which the wellhead hanger 32 has a receiving protrusion 62 at the upper end of the hanger 32 on the neck 50. As in FIG. 4, the receiving protrusion 62 is designed to engage with stopping protrusion 60. Regardless of relative placement of protrusion on the wellhead hanger 32, the interaction of the two protrusions allows torque applied to effect rotation of the wellhead hanger 32 and casing string 40 without over-torqueing.

Figure 6:
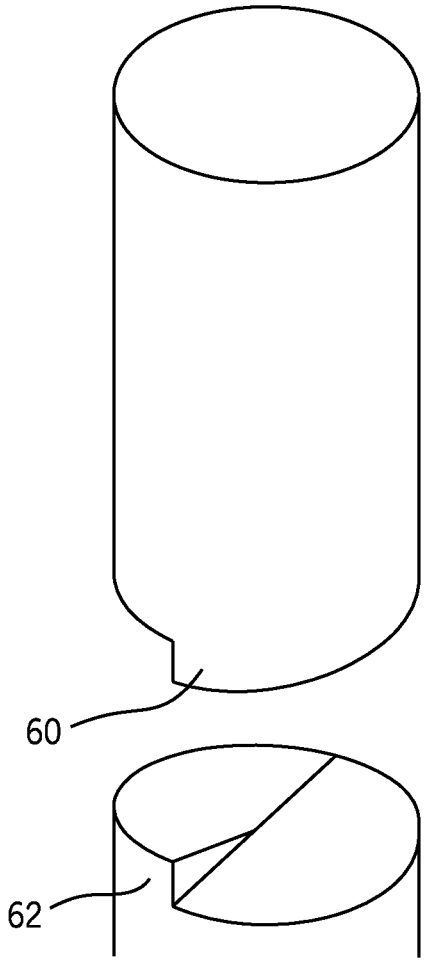
FIG. 6 is a schematic of a running tool and wellhead hanger shown in a disengaged configuration, in accordance with one embodiment.

As generally illustrated in FIG. 6 (with an upper running tool (e.g., running tool 48) and a lower hanger (e.g., hanger 32) simplified and represented as tubular modules), the stopping and receiving protrusions 60 and 62 may extend 180 degrees along circumference of their respective components. However, it is also envisaged that the protrusions extend over a greater or smaller portion of the respective components' circumferences. Finally, although the preceding description addresses the placement of casing by hangers used in wellheads, it is likewise envisioned that a hanger and running tool in accordance with an embodiment of the present disclosure may be used to place a liner in a well.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A well completion system, comprising:

a mandrel-style wellhead hanger comprising:

a neck portion configured to guide a running tool to a position about the wellhead hanger;

a threaded portion configured to threadedly engage the running tool during an operation; and a rotation-stopping protrusion configured to abut a mating protrusion of the running tool and prevent over-torqueing of the running tool with respect to the wellhead hanger; and a running tool with a threaded portion configured to couple the running tool to the wellhead hanger, wherein the mating protrusion of the running tool extends fixedly below the threaded portion of the running tool.

2. The well completion system of claim 1, wherein the rotation-stopping protrusion is positioned at the upper end of the neck portion.

3. The well completion system of claim 1, wherein the rotation-stopping protrusion is positioned on a shoulder portion of the wellhead hanger below the threaded portion.

4. The well completion system of claim 1, wherein the rotation-stopping protrusion extends 180 degrees along a circumference of the wellhead hanger.

* * * * *